US008794739B2

(12) United States Patent
Ikeda

(10) Patent No.: US 8,794,739 B2
(45) Date of Patent: Aug. 5, 2014

(54) LIQUID DROPLET JETTING APPARATUS

(71) Applicant: Brother Kogyo Kabushiki Kaisha, Aichi-Ken (JP)

(72) Inventor: Ayumu Ikeda, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 13/760,226

(22) Filed: Feb. 6, 2013

(65) Prior Publication Data

US 2013/0221126 A1 Aug. 29, 2013

(30) Foreign Application Priority Data

Feb. 27, 2012 (JP) ..... 2012-039741

(51) Int. Cl.
*B41J 2/165* (2006.01)

(52) U.S. Cl.
USPC ..... 347/29; 347/30; 347/22

(58) Field of Classification Search
USPC ..... 347/22, 29, 30
See application file for complete search history.

(56) References Cited

U.S. PATENT DOCUMENTS

| | | | | |
|---|---|---|---|---|
| 5,619,232 | A * | 4/1997 | Maeno | 347/30 |
| 2005/0212873 | A1 | 9/2005 | Usui et al. | |
| 2006/0001715 | A1 | 1/2006 | Umeda et al. | |
| 2007/0247483 | A1 | 10/2007 | Miyazawa | |
| 2008/0174645 | A1 | 7/2008 | Umeda et al. | |

FOREIGN PATENT DOCUMENTS

| | | |
|---|---|---|
| JP | 2002/225298 | 8/2002 |
| JP | 2004/255861 | 9/2004 |
| JP | 2007/307895 | 11/2007 |

* cited by examiner

*Primary Examiner* — Henok Legesse
(74) *Attorney, Agent, or Firm* — Frommer Lawrence & Haug LLP

(57) ABSTRACT

A liquid droplet jetting apparatus includes: a liquid droplet jetting head having a nozzle; a cap member having a suction port and an air intake port, and being attached to the liquid droplet jetting head to cover the nozzle; a switching mechanism connected to the suction port and the air intake port of the cap member and switching the air intake port to one of a state that the air intake port communicates with the atmosphere and a state that the air intake port is disconnected from the atmosphere; and a suction mechanism connected to the switching mechanism. The switching mechanism includes: a case member having a first opening, a suction port connection portion, and an air intake port connection portion; and a switching member contained in the case member to switch a position of the switching member with respect to the case member.

6 Claims, 11 Drawing Sheets

LIQUID DROPLET JETTING APPARATUS

CROSS REFERENCE TO RELATED APPLICATION

The present invention claims priority from Japanese Patent Application No. 2012-039741, filed on Feb. 27, 2012, the disclosure of which is incorporated herein by reference in its entirety.

BACKGROUND OF THE INVENTION

1. Field of the Invention

The present invention relates to liquid droplet jetting apparatuses which is configured to jet liquid droplets from nozzles.

2. Description of the Related Art

Japanese Patent Application Laid-Open No. 2002-225298 discloses so-called purge operation in which an ink inside the recording head is sucked from nozzles of the recording head by driving a suction pump connected with a suction cap, in a state that the nozzles are covered by the suction cap (a cap member). After the purge operation, the recording head is moved to a position not facing the suction cap, and then the suction pump is driven once again to suck the ink accumulated in the suction cap.

However, in the disclosure of Japanese Patent Application Laid-Open No. 2002-225298, after the purge, the recording head is separated from the suction cap in a state that the ink is accumulated in the cap member. Therefore, there is a possibility that the ink accumulated in the cap member spills out of the cap member.

SUMMARY OF THE INVENTION

An object of the present invention is to provide a liquid droplet jetting apparatus capable of discharging any liquid accumulated in a cap member without spilling out the liquid, after the liquid has been discharged from a liquid droplet jetting head to the cap member.

An aspect of the present invention there is provided a liquid droplet jetting apparatus configured to jet liquid droplets of a liquid, the apparatus including: a liquid droplet jetting head having a nozzle from which the liquid droplets are jetted; a cap member having a suction port and an air intake port, and to be attached to the liquid droplet jetting head to cover the nozzle; a switching mechanism connected to the suction port and the air intake port of the cap member and configured to switch the air intake port to one of a state in which the air intake port communicates with the atmosphere and a state in which the air intake port is disconnected from the atmosphere, the switching mechanism including: a case member having a first opening which is open to the atmosphere, a suction port connection portion which is connected to the suction port of the cap member, and an air intake port connection portion which is connected to the air intake port of the cap member; and a switching member contained in the case member to switch a position of the switching member with respect to the case member; and a suction mechanism connected to the switching mechanism, wherein in a state that the cap member is attached to the liquid droplet jetting head, the position of the switching member is switchable to one of a first position and a second position, the first position is a position, at which a first communication passage for connecting the suction port connection portion and the suction mechanism is formed between the switching member and the case member, and at which the first opening and the air intake port connection portion are disconnected, and the second position is a position, at which the first communication passage is formed between the switching member and the case member, and at which a second communication passage for connecting the first opening and the air intake port connection portion is formed between the switching member and the case member.

According to the liquid droplet jetting apparatus of the present invention, in the state that the cap member covers the nozzle and the switching member is positioned at the first position, the suction mechanism is driven to reduce the internal pressure of the sealed-up cap member, and it is possible to perform purge operation to discharge any liquid from the nozzle. Further, after the purge operation, by driving the suction mechanism in the state that the switching member is positioned at the second position, it is possible to discharge, from the cap member, the liquid accumulated in the cap member due to the purge operation without spilling out the liquid accumulated in the cap member.

BRIEF DESCRIPTION OF THE DRAWINGS

FIG. 5A shows the cross section of the lower portion, FIG. 5B shows the cross section of the central portion, and FIG. 5C shows the cross section of the upper portion.

DESCRIPTION OF THE PREFERRED EMBODIMENT

Next, a preferred embodiment of the present invention will be explained. Further, in the following explanation, the right side and the left side are defined as shown in FIG. 1.

Figure 1:
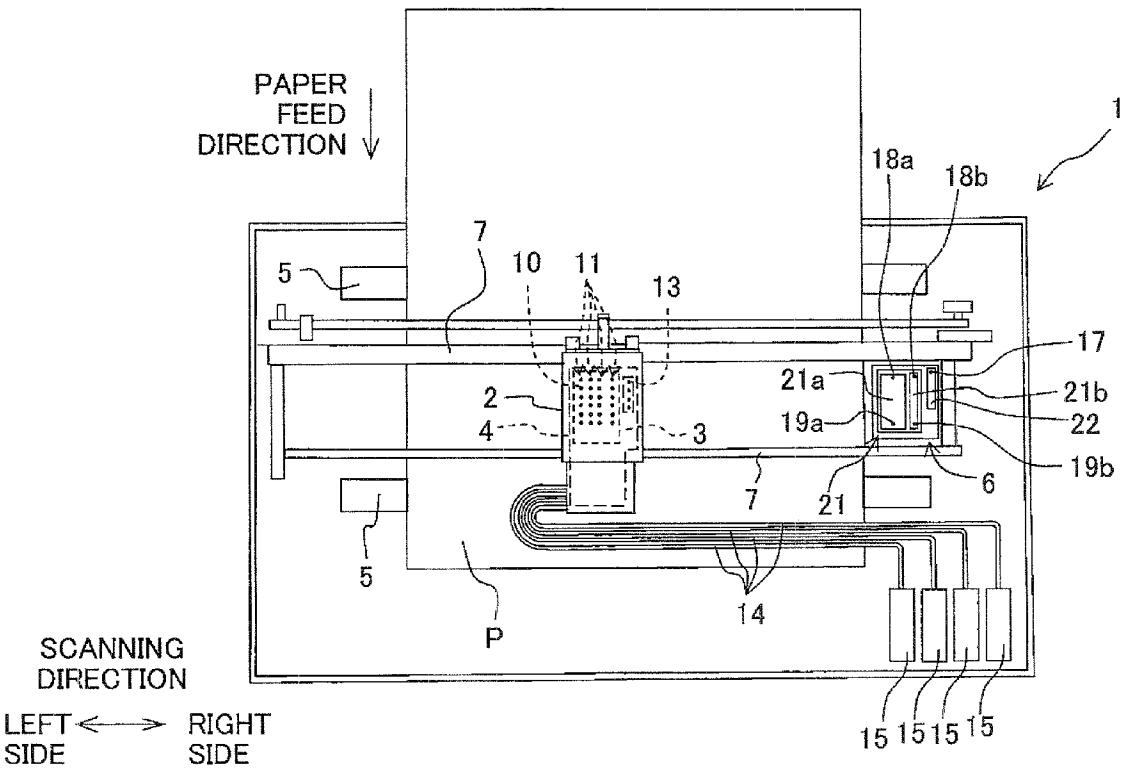
FIG. 1 is a schematic configuration diagram of a printer as an example of the liquid droplet jetting apparatus in accordance with an embodiment of the present invention.
Figure 2A:
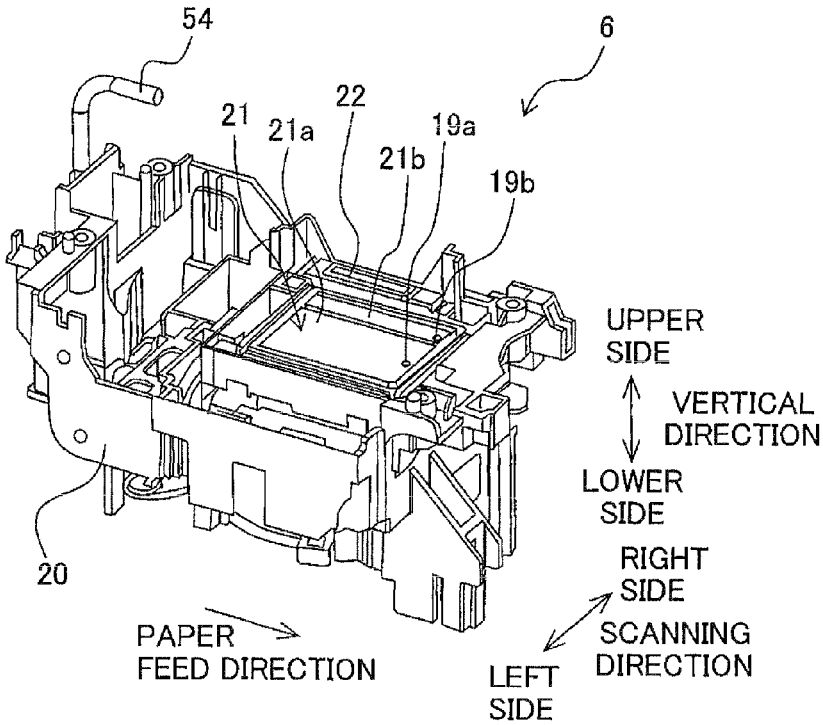
FIG. 2A is a perspective view of a maintenance unit of FIG. 1 as viewed from above.
Figure 2B:
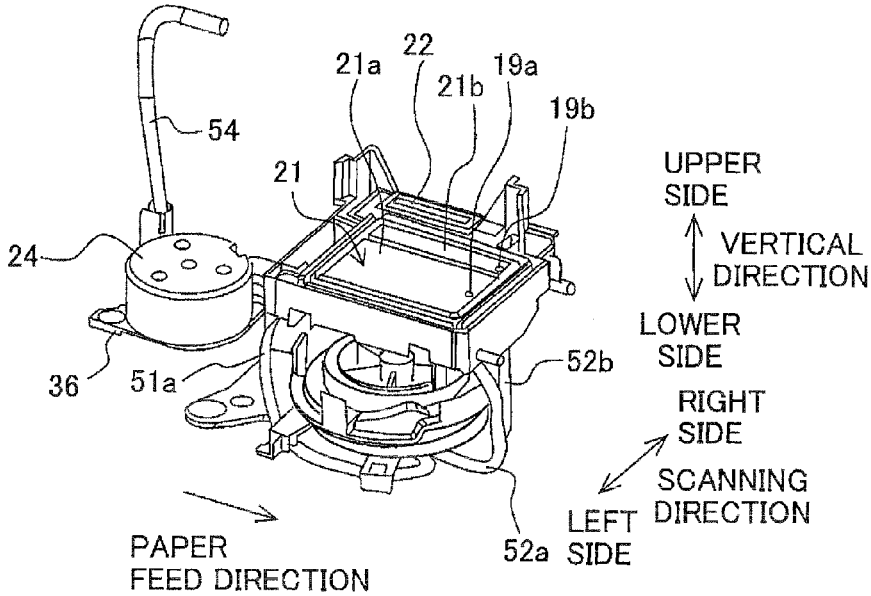
FIG. 2B shows an internal structure of the maintenance unit of FIG. 2A excluding its outer casing.
Figure 3A:
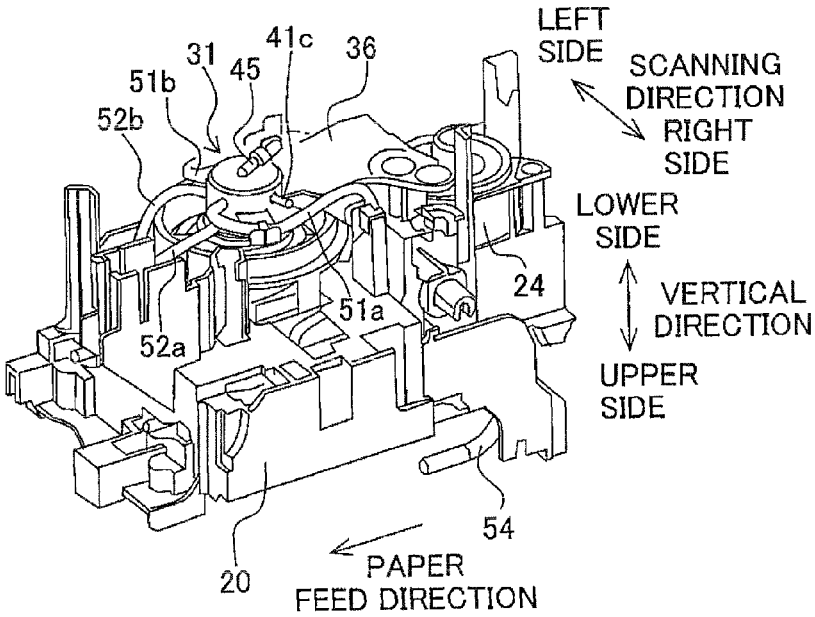
FIG. 3A is a perspective view of the maintenance unit as viewed from below.
Figure 3B:
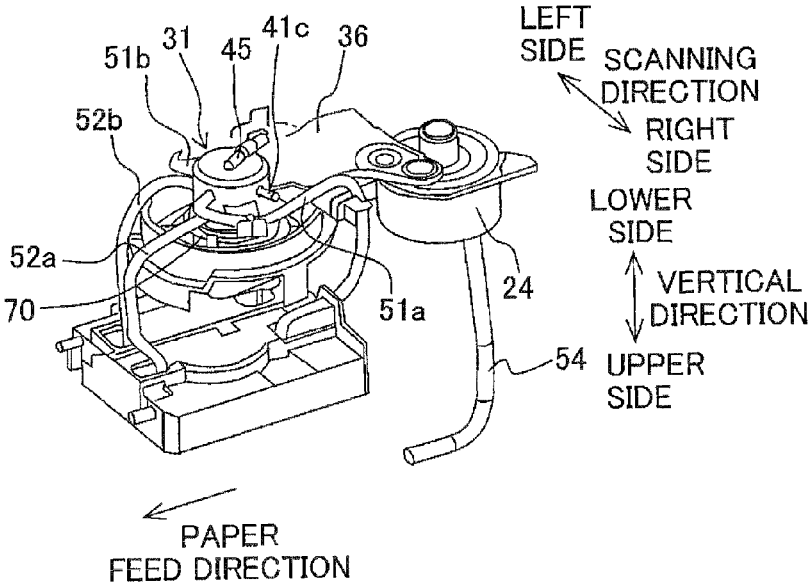
FIG. 3B shows the internal structure of the maintenance unit of FIG. 3A excluding its outer casing.
Figure 4:
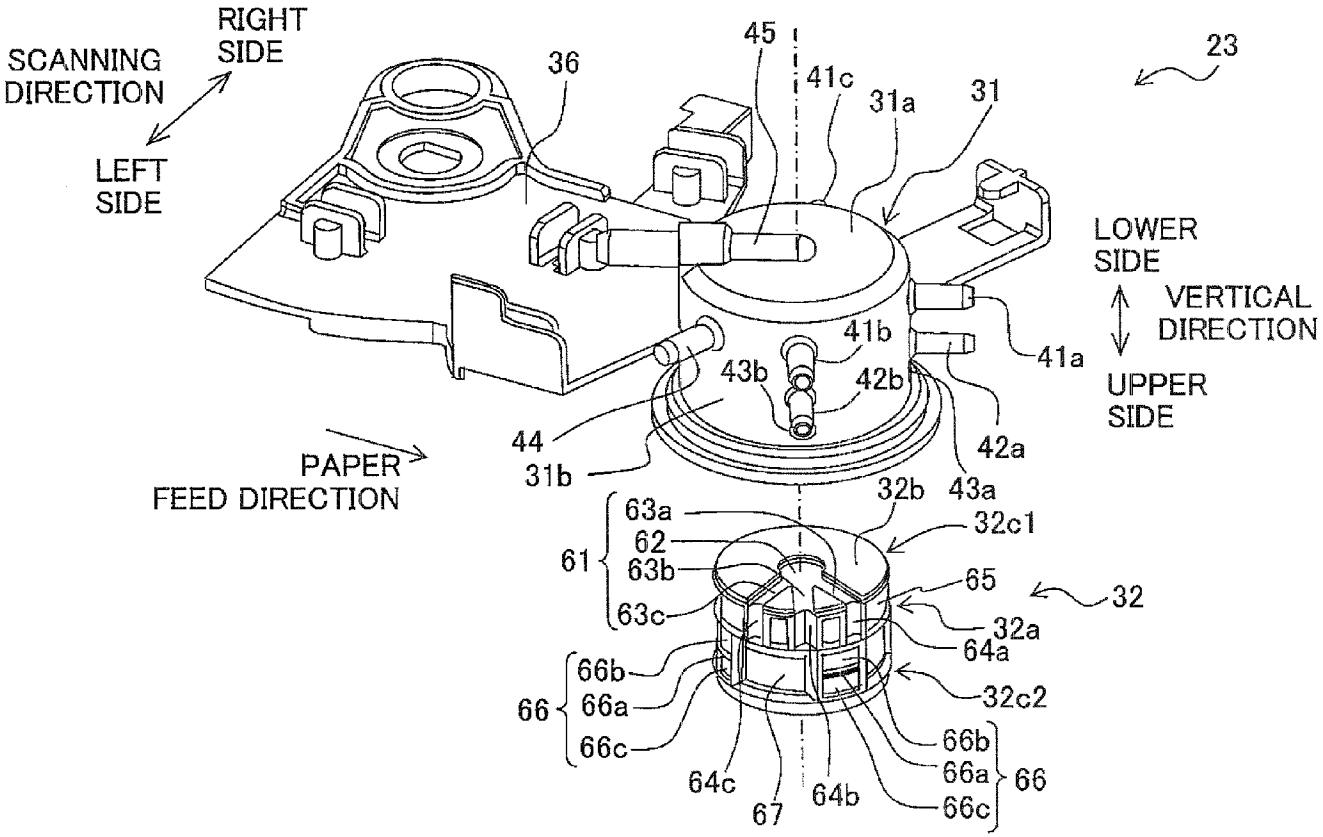
FIG. 4 is an exploded perspective view showing structures of a case member and a switching member constituting a switching device.

As shown in FIG. 1, a printer 1 (liquid droplet jetting apparatus) includes a carriage 2, a sub tank 3, an ink jet head 4 (liquid droplet jetting head), paper transport rollers 5, a maintenance unit 6, etc. The carriage 2 moves reciprocatingly along two guide rails 7 in a scanning direction.

The sub tank 3 is installed on the carriage 2. The sub tank 3 is connected with four ink cartridges 15 through four tubes 14. Inks of black, yellow, cyan and magenta are stored respectively in the four ink cartridges 15 in the arrangement order from the right side, and the four-color inks stored in those four ink cartridges 15 are supplied to the sub tank 3 through the tubes 14. Then, the sub tank 3 temporarily stores the above four-color inks supplied from the ink cartridges 15 respectively in four ink storage chambers (not shown) which are formed inside the sub tank 3.

Further, four air discharge ports 13 are provided in a portion of the sub tank 3 on the right side of the ink jet head 4 to communicate respectively with the above four ink storage chambers. From the air discharge ports 13, it is possible to discharge air bubbles in the sub tank 3 (in the ink storage chambers) by air discharge purge which will be described hereinafter.

The ink jet head 4 is installed on the lower end portion of the sub tank 3 and jets the inks from a plurality of nozzles 10 formed on its lower surface. To explain in more detail, in the ink jet head 4, four nozzle rows 11 are formed by the plurality of nozzles 10. The four nozzle rows 11 are arranged in the scanning direction. Each of the nozzle rows 11 extends in a paper feed direction perpendicular to the scanning direction. Then, from the nozzles 10 constituting each of the nozzle rows 11, the inks of black, yellow, cyan and magenta are jetted in the order of constituting the nozzle rows 11 from the right side.

The paper transport rollers 5 transport sheets of recording paper P in the paper feed direction. Then, the printer 1 performs printing on the recording paper P by jetting the inks from the ink jet head 4 reciprocatingly moving along with the carriage 2 in the scanning direction, onto the recording paper P transported in the paper feed direction by the paper transport rollers 5.

The maintenance unit 6 is arranged at a right end portion in the movement range of the carriage 2 and provided to perform maintenance operation of the ink jet head 4. As shown in FIG. 1 to FIG. 5C, the maintenance unit 6 is configured to include a suction cap 21 (a cap member), an air discharge cap 22, a switching unit 23 (an example of a switching mechanism), a suction pump 24 (an example of a suction mechanism), etc in a casing 20.

The suction cap 21 is arranged to face the ink jet head 4 when the carriage 2 has moved to the right side almost to the maximum extent. The suction cap 21 includes a cap portion 21*a* which faces the nozzles 10 constituting the three nozzle rows 11 on the left side and jetting the color inks (yellow, magenta and cyan) in the state that the suction cap 24 faces the ink jet head 4, and another cap portion 21*b* which faces the nozzles 10 constituting the nozzle row 11 on the rightmost side and jetting the black ink in the state that the suction cap 24 faces the ink jet head 4. Further, the cap portion 21*a* is provided with a suction port 18*a* for sucking the inks as will be described hereinafter, and an air intake port 19*a* for introducing external air into the cap portion 21*a* as will also be described hereinafter. Likewise, the cap portion 21*b* is also provided with a suction port 18*b* and an air intake port 19*b*.

The air discharge cap 22 is arranged to face the air discharge ports 13 in the state that the carriage 2 has moved to the right side almost to the maximum extent. Further, as will be described hereinafter, the air discharge cap 22 is provided with a suction port 17 for sucking air bubbles in the sub tank 3.

Further, the maintenance unit 6 is configured to be raised by an unshown raising and lowering mechanism when the carriage 2 has moved to the right side. When the carriage 2 has moved up to such a position that the ink jet head 4 faces the suction cap 21 and the air discharge ports 13 face the air discharge cap 22, the maintenance unit 6 is attached to the ink jet head 4. By virtue of this, the cap portion 21*a* covers the nozzles 10 forming the three nozzle rows 11 on the left side, and the cap portion 21*b* covers the nozzles 10 forming the nozzle row 11 on the rightmost side. Further, at this time, the air discharge cap 22 covers the air discharge ports 13.

The switching unit 23 (switching mechanism) is arranged below the suction cap 21. The switching unit 23 includes a case member 31, a rotary member 32 (a switching member).

The case member 31 is an approximately cylindrical member made of a synthetic resin material with the up-down or vertical direction as its central axis direction, and its upper end is opened while its lower end is closed by a wall portion 31*a*. Further, along an outer circumferential surface 31*b* of the case member 31, suction port connection portions 41*a* to 41*c*, air intake port connection portions 42*a* and 42*b*, atmosphere communication holes 43*a* and 43*b* (first openings), and an atmosphere communication portion 44 (second opening) are provided.

Figure 5A:
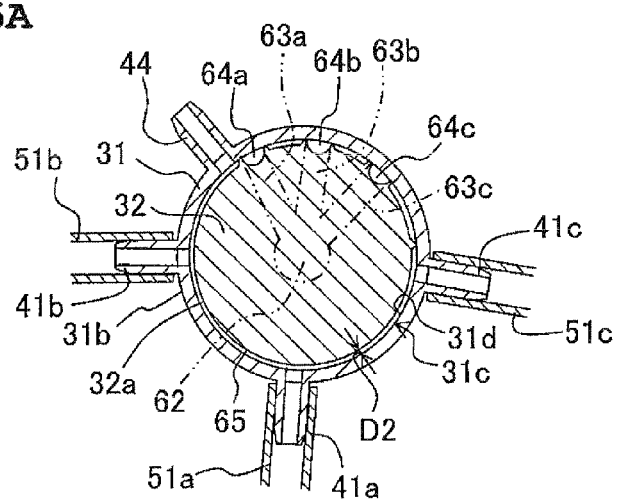
FIGS. 5A to 5C are cross-sectional views of the ease member and the switching member perpendicular to a central axis direction in normal states as viewed from below.
Figure 5B:
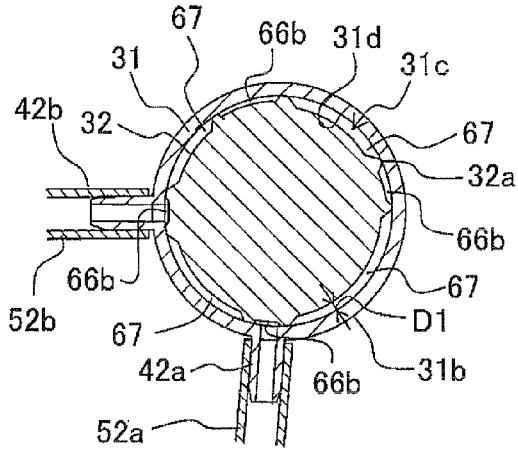
Figure 5C:
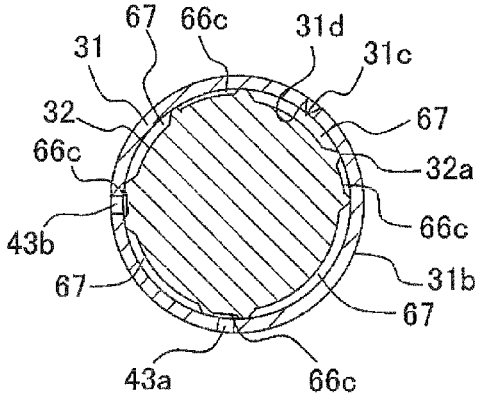

The suction port connection portions 41*a* to 41*c* are provided in the lower portion of the outer circumferential surface 31*b* assuming that the outer circumferential surface 31*b* is equally divided in to three areas in the vertical direction, to project outward from the outer circumferential surface 31*b* in radial directions of the case member 31. Further, to explain about a positional relationship between the suction port connection portions 41*a* to 41*c*, as observed from below (as shown in FIG. 5A), the suction port connection portion 41*b* is provided at a position approximately 90 degrees off from the suction port connection portion 41*a* clockwise around the central axis of the case member 31, while the suction port connection portion 41*c* is provided at a position approximately 90 degrees off from the suction port connection portion 41*a* counterclockwise around the central axis of the case member 31. Then, an internal space 31*c* of the case member 31 is in communication with the outside via each of the suction port connection portions 41*a* to 41*c*.

Further, the suction port connection portion 41*a* is connected to the suction port 18*a* of the cap portion 21*a* through a tube 51*a*. The suction port connection portion 41*b* is connected to the suction port 18*b* of the cap portion 21*b* through a tube 51*b*. The suction port connection portion 41*c* is connected to the suction port 17 of the air discharge cap 22 through a tube 51*c*.

The air intake port connection portions 42*a* and 42*b* are provided in the central portion of the outer circumferential surface 31*b* assuming that the outer circumferential surface 31*b* is divided into three areas in the vertical direction, to project outward from the outer circumferential surface 31*b* in radial directions of the case member 31. The air intake port connection portions 42*a* and 42*b* are formed almost right above the suction port connection portions 41*a* and 41*b*, respectively. Then, the internal space 31*c* of the case member 31 is also in communication with the outside via each of the air intake port connection portions 42*a* and 42*b*.

Further, the air intake port connection portion 42*a* is connected to the air intake port 19*a* of the cap portion 21*a* via a tube 52*a*. The air intake port connection portion 42*b* is connected to the air intake port 19*b* of the cap portion 21*b* via a tube 52*b*.

The atmosphere communication holes 43*a* and 43*b* are provided in the upper portion of the outer circumferential surface 31*b* assuming that the outer circumferential surface 31*b* is equally divided into three areas in the vertical direction, and formed almost right above the air intake port connection portions 42*a* and 42*b*, respectively. Then, the internal space 31*c* of the case member 31 is also in communication with the outside via the atmosphere communication holes 43*a* and 43*b*.

In the same manner as the suction port connection portions 41*a* to 41*c* are provided, the atmosphere communication portion 44 is provided in the lower portion of the outer circumferential surface 31*b* to project outward from the outer circumferential surface 31*b* in a radial direction of the case member 31. Further, to explain about a positional relationship between the atmosphere communication portion 44 and the suction port connection portions 41*a* to 41*c*, as observed from below, the atmosphere communication portion 44 is provided at a position approximately 45 degrees off from the suction port connection portion 41*b* clockwise around the central axis of the case member 31.

Further, a pump connection portion 45 is provided on the wall portion 31*a* closing the lower end of the case member 31. The pump connection portion 45 extends in a radial direction of the case member 31. The pump connection portion 45 is connected to the internal space 31*c* of the case member 31 at its base end portion positioned on the central axis of the case member 31, and its tip portion extends outward beyond the case member 31 in the radial direction of the case member 31.

Further, the case member 31 is provided with a pump installation portion 36 at the end portion of the outer circumferential surface 31*b* on the upstream side in the paper feed direction. The pump installation portion 36 extends up to such a position at which the pump installation portion 36 does not overlap with the suction cap 21 vertically, and the suction pump 24 is installed on the upper surface of its tip portion. The suction pump 24 is a tube pump or the like which is connected to the tip portion of the pump connection portion 45 through an unshown tube and, meanwhile, connected to an unshown waste tank through a tube 54 on the opposite side to the pump connection portion 45.

The rotary member 32 is an approximately columnar member made of a rubber material or the like with a diameter slightly greater than that of the internal space 31*c*. The rotary member 32 is inserted into the internal space 31*c* from the upper opening of the case member 31 to be contained in the internal space 31*c* in an elastically deformed state. By virtue of this, the outer circumferential surface 32*a* of the rotary member 32 is attached tightly to an inner circumferential surface 31*d* of the case member 31 which is the wall of the internal space 31*c*.

A groove 61 is formed in a lower surface 32*b* of the rotary member 32. The groove 61 includes a connection portion 62, and three branch portions 63*a* to 63*c*. The connection portion 62 is positioned in the approximately central portion of the lower surface 32*b* of the rotary member 32, and connected to the base end portion of the pump connection portion 45. The three branch portions 63*a* to 63*c* are connected to the connection portion 62 at their respective base end portions, and extend up to the outer circumferential surface 32*a* while branching off in three directions along the radial direction of the rotary member 32 from the connection portion 62. Here, the angle formed between the branch portion 63*a* and the branch portion 63*b* with respect to the central axis of the rotary member 32 is approximately the same as the angle formed between the branch portion 63*b* and the branch portion 63*c* with respect to the central axis of the rotary member 32 (for example, 35 degrees or so).

Further, the outer circumferential surface 32*a* of the rotary member 32 is divided into two portions: a lower portion 32*c*1 about one third on the lower side, and an upper portion 32*c*2 about two thirds on the upper side.

Three notches 64*a* to 64*c* and a groove 65 (second groove) are formed in the lower portion 32*c*1. The notches 64*a* to 64*c* are formed at portions of the lower portion 32*c*1 vertically overlapping with the tip portions of the three branch portions 63*a* to 63*c* to communicate with the branch portions 63*a* to 63*c*, respectively. The groove 65 extends continuously along the circumferential direction of the outer circumferential surface 32*a* through the most part of the lower portion 32*c*1 except the portions at which the notches 64*a* to 64*c* are formed.

In the upper portion 32*c*2, four disconnection grooves 66 and four communication grooves 67 (first grooves) are formed alternately along the circumferential direction of the outer circumferential surface 32*a*. Each of the disconnection grooves 66 is provided with a partition wall 66*a* in the approximately central portion along the vertical direction, and two areas 66*b* and 66*c* are separated in the vertical direction by the partition wall 66*a*. Further, one of the four disconnection grooves 66 is funned in a position vertically overlapping with the notch 64*a*, and the other three disconnection grooves 66 are formed in positions which vertically overlap the groove 65 and the like but do not vertically overlap with the notches 64*a* to 64*c*.

The four communication grooves 67 are longer than the disconnection grooves 66 along the circumferential direction of the outer circumferential surface 32*a*, and each of the four communication grooves 67 extends continuously through almost the entire area of the upper portion 32*c*2 in the vertical direction. Further, one of the four communication grooves 67 is formed at a position vertically overlapping with the notches 64*b* and 64*c*, and the other three communication grooves 67 are formed at positions vertically overlapping with the groove 65. Further, the depth D1 of each of the communication grooves 67 is greater than the depth D2 of the groove 65.

Then, by containing the rotary member 32 in the internal space 31*c* of the case member 31, a first communication passage is formed between the notches 64*a* to 64*c* and the inner circumferential surface 31 d of the case member 31. Further, a second communication passage is formed between the communication grooves 67 and the inner circumferential surface 31*d* of the case member 31. Further, a third communication passage is formed between the groove 65 and the inner circumferential surface 31*d* of the case member 31. Further, because the depth D1 of the communication grooves 67 is greater than the depth D2 of the groove 65, the second communication passage has a smaller flow passage resistance than a flow passage resistance of the third communication passage.

Further, the rotary member 32 is connected to a drive mechanism 70 including an unshown motor. The rotary member 32 is configured such that by driving the drive mechanism 70, the rotary member 32 is rotated about the central axis of the case member 31 while sliding on the inner circumferential surface 31*d* of the case member 31.

Next, operation of the maintenance unit 6 will be explained. Except when performing printing operation, or performing purge operation and air discharge purge operation which will be described hereinafter, the maintenance unit 6 remains in a standby state which will be explained next. On the other hand, when the inks in the ink jet head 4 have thickened, or when air bubbles have flowed into the sub tank 3, etc., the maintenance unit 6 performs the purge operation to discharge the thickened inks in the ink jet head 4, or the air discharge purge operation to discharge the air bubbles in the sub tank 3.

In the standby state, the carriage 2 is positioned to face the maintenance unit 6, and the nozzles 10 are covered by the suction cap 21 (cap portions 21*a* and 21*b*). By virtue of this, the ink in the nozzles 10 is prevented from being dried.

At the time, the rotary member 32 is in such a state that the groove 65 is positioned (in a third position) to span the suction port connection portions 41*a* and 41*b* and the atmosphere communication portion 44 as shown in FIG. 5A. By virtue of this, the cap portion 21*a* is in communication with the atmosphere via the suction port 18*a*, tube 51*a*, suction port connection portion 41*a*, groove 65 (third communication passage), and atmosphere communication portion 44. Further, the cap portion 21*b* is in communication with the atmosphere via the suction port 18*b*, tube 51*b*, suction port connection portion 41*b*, groove 65 (third communication passage), and atmosphere communication portion 44.

In this manner, in the embodiment, because the cap portions 21*a* and 21*b* are in communication with the atmosphere in the standby state, when the nozzles 10 are covered by the cap portions 21*a* and 21*b*, no pressure variation may occur in the internal space of the cap portions 21*a* and 21*b*. By virtue of this, it is possible to prevent any destruction of the meniscuses of the inks in the nozzles 10.

At this time, since the depth D2 of the groove 65 is smaller than the depth D1 of the communication grooves 67 and hence there is a great flow passage resistance in the third communication passage formed between the groove 65 and the inner circumferential surface 31*d* of the case member 31, there is a small amount of air movement between the outside and the cap portions 21*a* and 21*b*. Therefore, it is possible to restrain the nozzles 10 from being dried to the maximum extent due to communication of the cap portions 21*a* and 21*b* with the atmosphere.

Figure 6A:
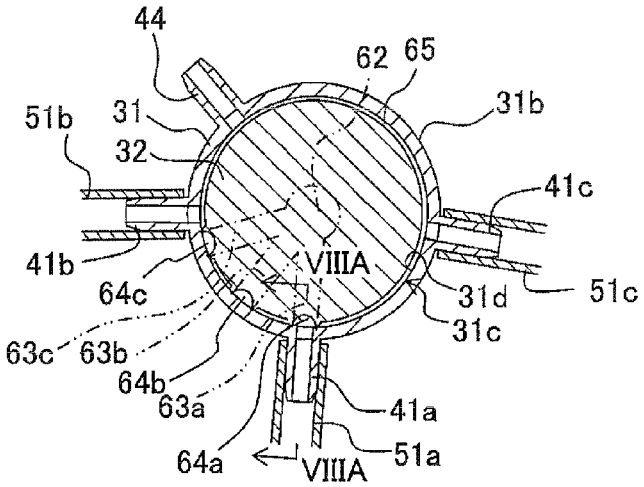
FIGS. 6A to 6C are cross-sectional views corresponding respectively to FIGS. 5A to 5C when performing purge operation for color inks.

When discharging the color inks from the ink jet head 4 by the purge operation, as shown in FIG. 6A, the rotary member 32 is rotated until the notch 64*a* reaches a position to face the suction port connection portion 41*a* (first position). By virtue of this, the cap portion 21*a* is connected to the suction pump 24 via the suction port 18*a*, tube 51*a*, suction port connection portion 41*a*, first communication passage (notch 64*a*), branch portion 63*a*, connection portion 62, pump connection portion 45, and an unshown tube.

Figure 6B:
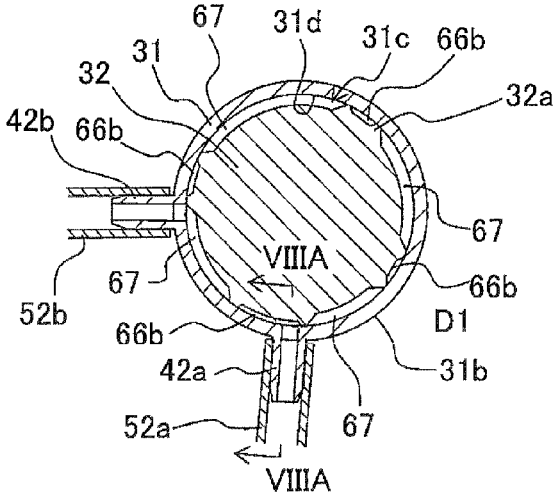
Figure 6C:
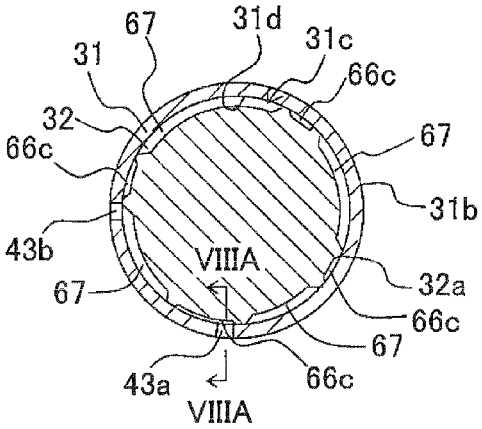

Further, in this state, as shown in FIGS. 6B and 6C, the disconnection grooves 66 face the air intake port connection portion 42*a* and the atmosphere communication hole 43*a*, and the air intake port connection portion 42*a* is connected to the area 66*b* of the disconnection grooves 66 while the atmosphere communication hole 43*a* is connected to the area 66*c* of the disconnection grooves 66. Therefore, the air intake port connection portion 42*a* is disconnected from the atmosphere communication hole 43*a* by the partition wall 66*a*, and accordingly the cap portion 21*a* connected to the air intake port connection portion 42*a* via the tube 52*a* is not in communication with the atmosphere.

Figure 8A:
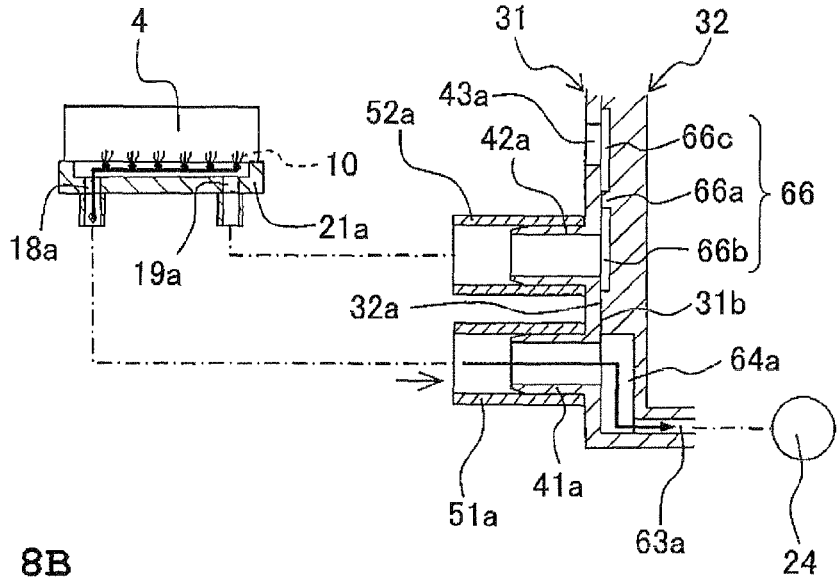
FIG. 8A shows a connectional relation between a suction cap, a suction pump, and the portion shown by the cross section along the line VIIIA-VIIIA in FIGS. 6A to 6C.

Next, the suction pump 24 is driven in the above state. Then, since the cap portion 21*a* is not in communication with the atmosphere just as described above, the internal pressure of the cap portion 21*a* is reduced. As a result, as shown in FIG. 8A, the inks in the ink jet head 4 are discharged to the cap portion 21*a* from the nozzles 10, and the discharged inks are sucked from the suction port 18*a*.

Figure 7A:
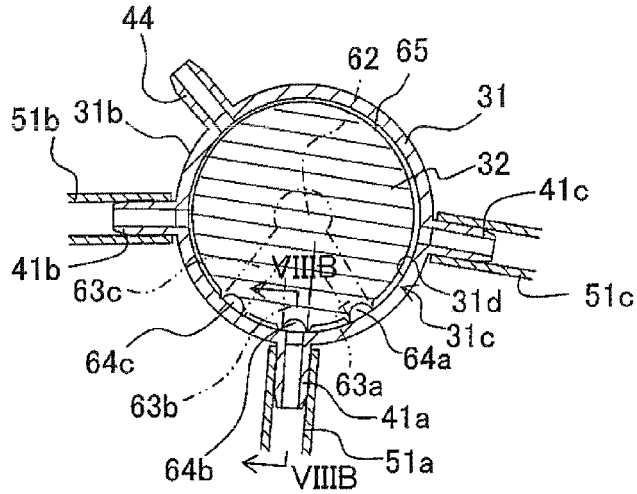
FIGS. 7A to 7C are cross-sectional views corresponding respectively to FIGS. 5A to 5C when discharging the inks accumulated in a cap after the purge operation for the color inks.

Afterwards, when discharge of the color inks is completed, the suction pump 24 is stopped and, as shown in FIG. 7A, the rotary member 32 is rotated until the notch 64*b* reaches a position to face the suction port connection portion 41*a* (second position). By virtue of this, the cap portion 21*a* is connected to the suction pump 24 via the suction port 18*a*, tube 51*a*, suction port connection portion 41*a*, first communication passage (notch 64*b*), branch portion 63*b*, connection portion 62, pump connection portion 45, and an unshown tube.

Figure 7B:
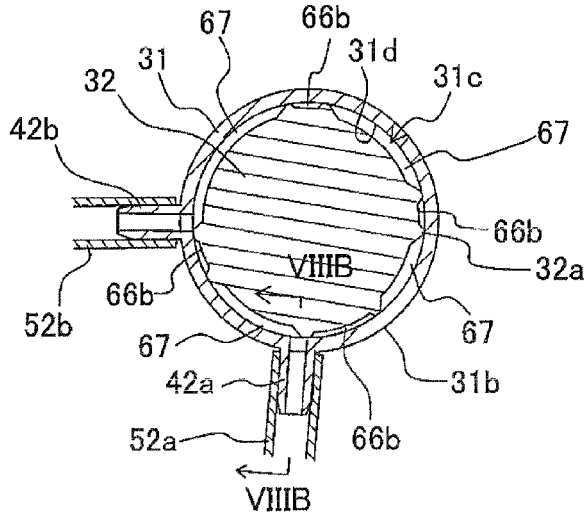
Figure 7C:
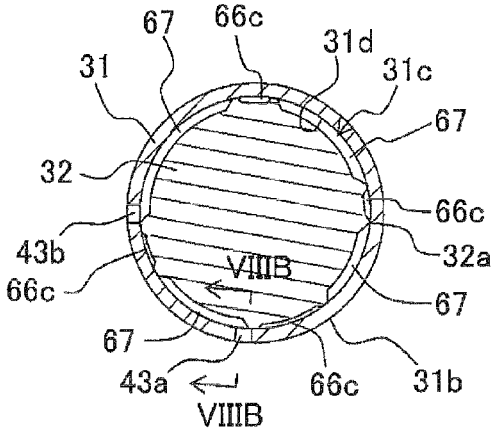

Further, in this state, the communication grooves 67 face the air intake port connection portion 42*a* and the atmosphere communication hole 43*a* as shown in FIGS. 7B and 7C. By virtue of this, the air intake port connection portion 42*a* and the atmosphere communication hole 43*a* are connected via the communication grooves 67. Therefore, the cap portion 21*a* is in communication with the atmosphere via the tube 52*a*, air intake port connection portion 42*a*, second communication passage (communication grooves 67), and atmosphere communication hole 43*a*.

Figure 8B:
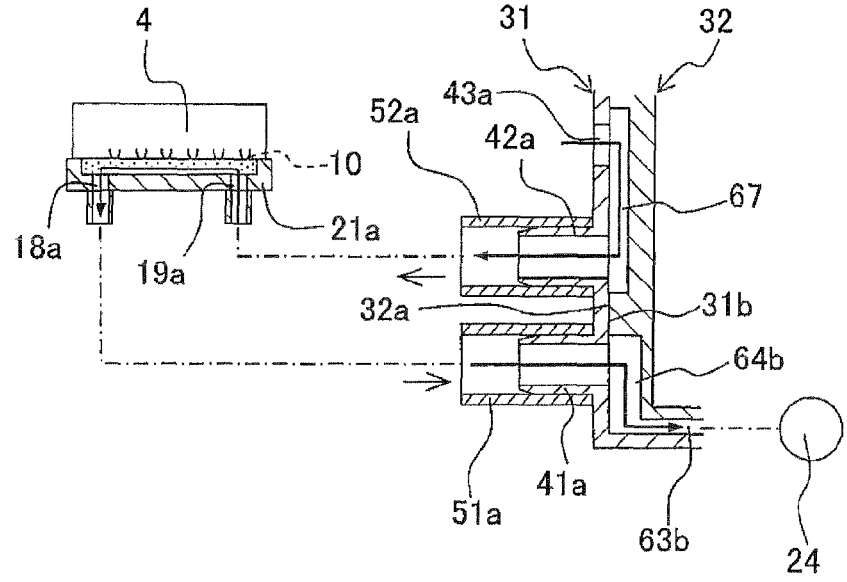
FIG. 8B shows a connectional relation between the suction cap, the suction pump, and the portion shown by the cross section along the line VIIIB-VIIIB in FIGS. 7A to 7C.

Next, the suction pump 24 is driven in the above state. Then, since the cap portion 21*a* is in communication with the atmosphere just as described above, as shown in FIG. 8B, the color inks accumulated in the cap portion 21*a* are sucked from the suction port 18*a*, and the external air is introduced into the cap portion 21*a* from the air intake port 19*a* (an example of idle suction). Further, since the external air is introduced into the cap portion 21*a* at this time, no pressure variation may occur in the cap portion 21*a*, and hence no inks may be discharged from the nozzles 10.

Then, when discharge of the color inks accumulated in the cap portion 21*a* is completed, the suction pump 24 is stopped and, thereafter, the rotary member 32 is rotated to return to the position in the aforementioned standby state.

Figure 9A:
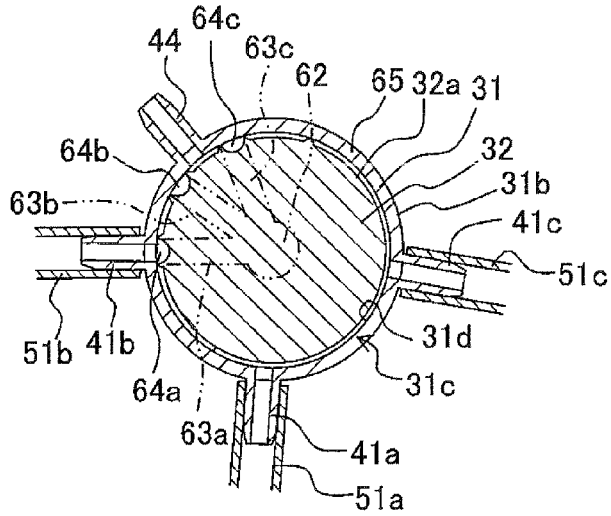
FIGS. 9A to 9C are cross-sectional views corresponding respectively to FIGS. 5A to 5C when performing purge operation for black ink.

When discharging the black ink from the ink jet head 4 by the purge operation, as shown in FIG. 9A, the rotary member 32 is rotated until the notch 64*a* reaches a position to face the suction port connection portion 41*b* (the first position). By virtue of this, the cap portion 21*b* is connected to the suction pump 24 via the suction port 18*b*, tube 51*b*, suction port connection portion 41*b*, first communication passage (notch 64*a*), branch portion 63*a*, connection portion 62, pump connection portion 45, and an unshown tube.

Figure 9B:
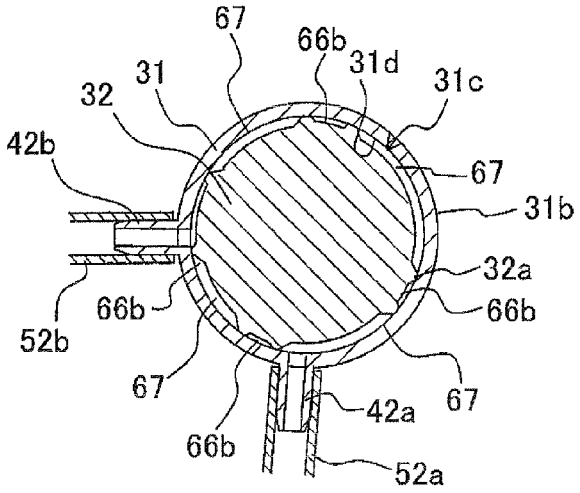
Figure 9C:
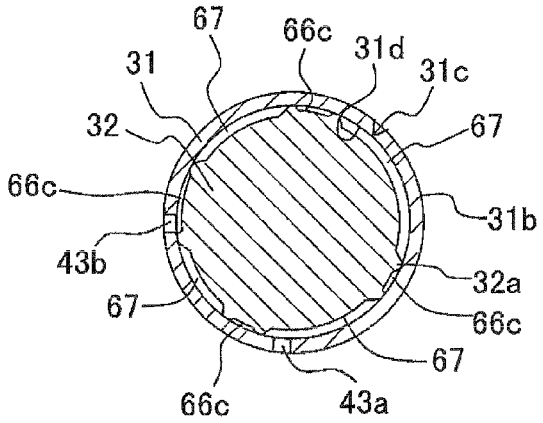

Further, in this state, as shown in FIGS. 9B and 9C, the disconnection grooves 66 face the air intake port connection portion 42*b* and the atmosphere communication hole 43*b*, and the air intake port connection portion 42*b* is connected to the area 66*b* of the disconnection grooves 66 and the atmosphere communication hole 43*b* is connected to the area 66*c* of the disconnection grooves 66. Therefore, the air intake port connection portion 42*b* is disconnected from the atmosphere communication hole 43*b* by the partition wall 66*a*, and accordingly the cap portion 21*b* connected to the air intake port connection portion 42*b* via the tube 52*b* is not in communication with the atmosphere.

Next, the suction pump 24 is driven in the above state. Then, since the cap portion 21*b* is not in communication with the atmosphere just as described above, the internal pressure of the cap portion 21*b* is reduced. As a result, the black ink in the ink jet head 4 is discharged to the cap portion 21*b* from the nozzles 10, and the discharged ink is sucked from the suction port 18*b*.

Figure 10A:
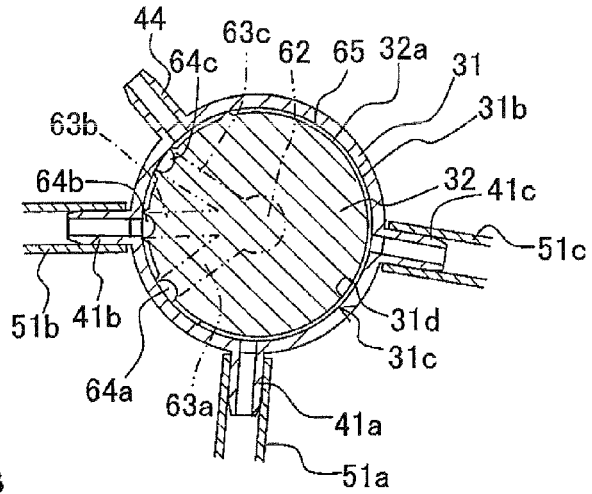
FIGS. 10A to 10C are cross-sectional views corresponding respectively to FIGS. 5A to 5C when discharging the ink accumulated in the cap after the purge operation for the black ink.

Afterwards, when discharge of the black ink is completed, the suction pump 24 is stopped and, as shown in FIG. 10A, the rotary member 32 is rotated until the notch 64*b* reaches a position to face the suction port connection portion 41*b* (the second position). By virtue of this, the cap portion 21*b* is connected to the suction pump 24 via the suction port 18*b*, tube 51*b*, suction port connection portion 41*b*, first communication passage (notch 64*b*), branch portion 63*b*, connection portion 62, pump connection portion 45, and an unshown tube.

Figure 10B:
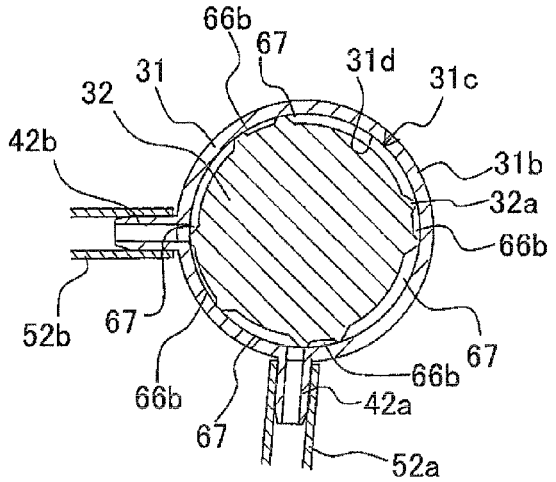
Figure 10C:
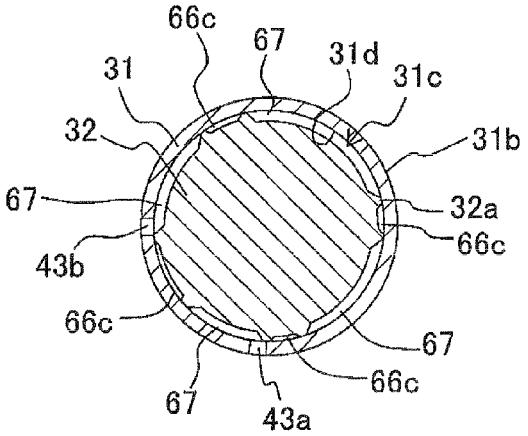

Further, in this state, the communication grooves 67 face the air intake port connection portion 42*b* and the atmosphere communication hole 43*b* as shown in FIGS. 10B and 10C. By virtue of this, the air intake port connection portion 42*b* and the atmosphere communication hole 43*b* are connected via the communication grooves 67. Therefore, the cap portion 21*b* is in communication with the atmosphere via the tube 52*b*, air intake port connection portion 42*b*, second communication passage (communication grooves 67), and atmosphere communication hole 43*b*.

Next, the suction pump 24 is driven in the above state. Then, since the cap portion 21*b* is in communication with the atmosphere as described above, the black ink accumulated in the cap portion 21*b* is sucked from the suction port 18*b*, while the external air is introduced into the cap portion 21*b* from the air intake port 19*b* (example of idle suction). Further, since the external air is introduced into the cap portion 21*b* at this time, no pressure variation may occur in the cap portion 21*b*, and hence no ink may be discharged from the nozzles 10.

Then, when discharge of the black ink accumulated in the cap portion 21*b* is completed, the suction pump 24 is stopped and, thereafter, the rotary member 32 is rotated to return to the position in the aforementioned standby state.

Figure 11A:
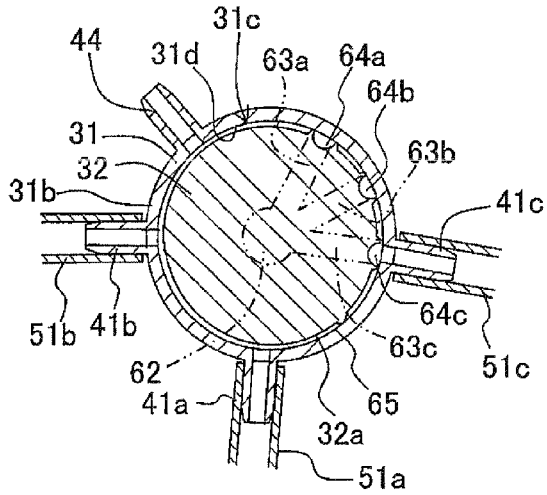
FIGS. 11A to 11C are cross-sectional views corresponding respectively to FIGS. 5A to 5C when performing air discharge purge operation.
Figure 11B:
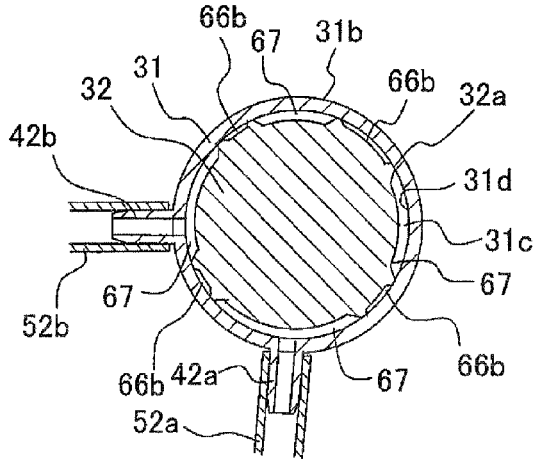
Figure 11C:
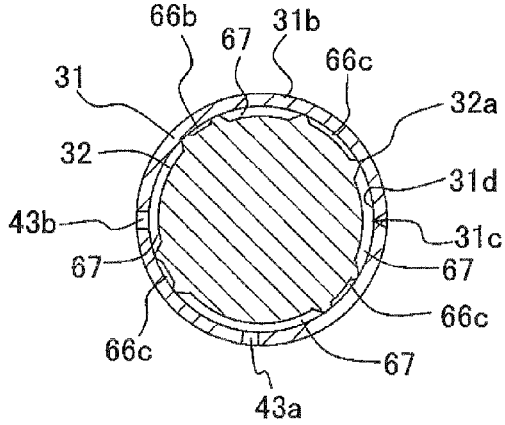

When discharging the air bubbles in the sub tank 3 by the air discharge purge operation, as shown in FIG. 11A, the rotary member 32 is rotated until the notch 64*c* reaches a position to face the suction port connection portion 41*c*. By virtue of this, the air discharge cap 22 is connected to the suction pump 24 via the suction port 17, tube 51*c*, suction port connection portion 41*c*, first communication passage (notch 64*c*), branch portion 63*c*, connection portion 62, pump connection portion 45, and an unshown tube.

Next, the suction pump 24 is driven in the above state. Then, the air bubbles in the sub tank 3 are discharged from the air discharge ports 13 connected to the air discharge cap 22. Then, when discharge of the air bubbles from the sub tank 3 is completed, the suction pump 24 is stopped and, thereafter, the rotary member 32 is rotated to return to the position in the aforementioned standby state.

According to the embodiment explained above, after discharging the black or color inks from the ink jet head 4 by the purge operation, the inks accumulated in the cap portions 21*a* and 21*b* are discharged and then the standby state is restored. Therefore, it is possible to prevent the inks accumulated in the cap portions 21*a* and 21*b* from spilling out of the cap portions 21*a* and 21*b*.

Further, in the embodiment, the depth D1 of the communication grooves 67, which is used to actively introduce the external air into the cap portions 21*a* and 21*b* when discharging the inks accumulated in the cap portions 21*a* and 21*b*, is greater than the depth D2 of the groove 65, which is used to merely let the inside of the cap portions 21*a* and 21*b* communicate with the atmosphere. Therefore, the second communication passage has a small flow passage resistance, and when discharging the inks in the cap portions 21*a* and 21*b*, it is possible to smoothly introduce the external air into the cap portions 21*a* and 21*b*.

Further, during the standby time at which the purge operation, air discharge purge operation or printing operation is not performed, because the nozzles 10 arc covered by the cap portions 21*a* and 21*b*, inks in the nozzles 10 are prevented from being dried. Further, because the cap portions 21*a* and 21*b* are in communication with the atmosphere at this time, it is possible to prevent pressure variation in the cap portions 21*a* and 21*b*. By virtue of this, for example, it is possible to prevent any destruction of the meniscuses of the inks in the nozzles 10 due to some pressure variation in the cap portions 21*a* and 21*b*.

Here, the third communication passage (the groove 65) for making the cap portions 21*a* and 21*b* communicate with the atmosphere serves to prevent the cap portions 21*a* and 21*b* from pressure variation. That is, different from the second communication passage (the communication grooves 67), the groove 65 does not serve to actively bring about airflow. In the embodiment, therefore, by making the depth D2 of the groove 65 be smaller than the depth D1 of the communication grooves 67 used to actively introduce the external air into the cap portions 21*a* and 21*b*, the flow passage resistance is increased in the third communication passage. By virtue of this, the air movement amount is decreased between the cap portions 21*a* and 21*b* and the outside. Hence, it is possible to restrain the nozzles 10 from being dried to the maximum extent due to communication between the cap portions 21*a* and 21*b* and the atmosphere.

Further, in the embodiment, it is configured that in the switching unit 23, the approximately columnar rotary member 32 is contained in the internal space 31*c* of the approximately cylindrical case member 31. Then, the positions of the notches 64*a* to 64*c*, groove 65, disconnection grooves 66 and communication grooves 67 are changed by sliding the rotary member 32 along the inner circumferential surface 31*d* of the case member 31 while rotating the switching unit 23 about the central axis of the case member 31, so as to switch to one of the aforementioned first to third positions.

In a case that the switching unit 23 has the above configuration, by making the depth D2 of the groove 65 be smaller than the depth D1 of the communication grooves 67, it is possible to easily make the flow passage resistance of the second communication passage be smaller than the flow passage resistance of the third communication passage.

Further, in the case that the switching unit 23 has the above configuration, if the case member 31 has a low circularity, then tightness between the inner circumferential surface 31*d* of the case member 31 and the outer circumferential surface 32*a* of the rotary member 32 decreases, and there is a possibility that the inks leak out of the interspace therebetween.

On the other hand, the case member 31 made of a synthetic resin material is first formed by a mold fitted with pins corresponding to the holes for forming the suction port connection portions 41*a* to 41*c*, air intake port connection portions 42*a* and 42*b*, atmosphere communication holes 43*a* and 43*b* and atmosphere communication portion 44, and then completed by pulling out the pins. However, pulling the pins exerts forces on the case member 31 in radial directions. Due to these forces, there is a possibility that the circularity of the case member 31 decreases. Further, if a number of such kinds of holes are arranged along the circumferential direction of the case member 31, then because the forces are exerted respectively on the case member 31 in mutually different directions, the circularity is subject to a significant decrease.

To address this problem, in the embodiment, the suction port connection portion 41*a*, air intake port connection portion 42*a* and atmosphere communication hole 43*a*, and the suction port connection portion 41*b*, air intake port connection portion 42*b* and atmosphere communication hole 43*b* are aligned respectively in the central axis direction of the case member 31. That is, their positions with respect to the circumferential direction of the case member 31 accord with each other. Therefore, a smaller number of pins are aligned in the circumferential direction of the case member 31, and thus it is possible to restrain, to the maximum extent, the circularity decrease of the case member 31 due to pulling the pins at the time of formation.

Further, in the embodiment, because the cap portions 21*a* and 21*b* are connected with the internal space 31*c* of the case member 31 via the air intake ports 19*a* and 19*b*, tubes 52*a* and 52*b* and air intake port connection portions 42*a* and 42*b*, it is possible for the inks in the cap portions 21*a* and 21*b* to flow reversely from the air intake port connection portions 42*a* and 42*b* into the second communication passage (the communication grooves 67). However, in the embodiment, because the atmosphere communication holes 43*a* and 43*b* are arranged above the air intake port connection portions 42*a* and 42*b* to make the air intake port connection portions 42*a* and 42*b* communicate with the atmosphere via the communication grooves 67, even if the inks flow into the second communication passage (the communication grooves 67), the influent inks are less likely to leak out of the case member 31 from the atmosphere communication holes 43*a* and 43*b*.

Next, explanations will be made with respect to a few modifications which apply various changes to the above embodiment. Note that, however, the same reference numerals will be used to refer to the same components in terms of configuration as those in the above embodiment, any explanation of which will be omitted as appropriate.

In the above embodiment, the air intake port connection portion 42*a* and atmosphere communication hole 43*a*, and the air intake port connection portion 42*b* and atmosphere communication hole 43*b* are aligned respectively on the outer circumferential surface 31*b* of the case member 31 in the vertical direction (in the central axis direction of the case member 31). However, the present invention is not limited to this alignment. It is possible to provide the air intake port connection portion 42*a* and atmosphere communication hole 43*a*, and the air intake port connection portion 42*b* and atmosphere communication hole 43*b* respectively at some positions deviating from each other along the circumferential direction of the outer circumferential surface 31*b* of the case member 31.

Further, in the above embodiment, the atmosphere communication holes 43*a* and 43*b* are arranged above the air intake port connection portions 42*a* and 42*b*. However, the present invention is not limited to this arrangement. Alternatively, the atmosphere communication holes 43*a* and 43*b* may be formed either at the same height as the air intake port connection portions 42*a* and 42*b* or below the air intake port connection portions 42*a* and 42*b*.

Further, in the above embodiment, the depth D1 of the communication grooves 67 is greater than the depth D2 of the groove 65 such that the second communication passage has a smaller flow passage resistance than a flow passage resistance of the third communication passage. However, the present invention is not limited to this configuration. For example, the communication grooves 67 may be longer than the groove 65 in the vertical direction such that the second communication passage can still have a smaller flow passage resistance than the flow passage resistance of the third communication passage.

Further, the second communication passage is not limited to having a smaller flow passage resistance than the third communication passage, but may instead have the same flow passage resistance as the third communication passage. In this case, the present invention is not limited to separately providing the communication grooves 67 constituting the second communication passage and the groove 65 constituting the third communication passage, but common grooves may be provided in the rotary member 32 to form the second communication passage and the third communication passage.

Further, in the above embodiment, in order to form the third communication passage for the cap portions 21*a* and 21*b* to communicate with the atmosphere during the standby time, the groove 65 is formed in the outer circumferential surface 32*a* of the rotary member 32. However, the third communication passage (the groove 65) may not be provided, and the inside of the cap portions 21*a* and 21*b* may be sealed up during the standby time.

Further, in the above embodiment, the approximately columnar rotary member 32 is contained in the internal space 31*c* of the approximately cylindrical case member 31, and the rotary member 32 is rotated about the central axis of the case member 31 while making the outer circumferential surface 32*a* slide on the inner circumferential surface 31*d* of the case member 31, so as to switch to one of the aforementioned first to third positions. However, the present invention is not limited to this configuration.

For example, it is also possible to switch between the first to third positions by another configuration which includes a case member and a switching member movably contained in the case member so as to make it possible to switch to one of the first to third positions by letting the switching member contained in the internal space of the case member slide in the central axis direction of the case member. In this case, the case member may alternatively have another shape than the approximately cylindrical shape. Further, the switching member contained in the case member may also alternatively have another shape than the approximately columnar shape. Further, in this case, it is also possible to form grooves or the like in the outer circumferential surface of the switching member to constitute the first to third communication passages between the switching member and the case member in conformity with the shape of the case member and the switching member, and the movement direction of the switching member relative to the case member.

While the above explanations are made with an example of applying the present invention to a printer configured to perform printing by jetting inks from nozzles, without being limited to this example, it is also possible to apply the present invention to any liquid droplet jetting apparatuses jetting liquid droplets other than inks from nozzles.

What is claimed is:

1. A liquid droplet jetting apparatus configured to jet liquid droplets of a liquid, the apparatus comprising:

a liquid droplet jetting head having a nozzle from which the liquid droplets are jetted;

a cap member having a suction port and an air intake port, and to be attached to the liquid droplet jetting head to cover the nozzle;

a switching mechanism connected to the suction port and the air intake port of the cap member and configured to switch the air intake port between a state in which the air intake port communicates with the atmosphere and a state in which the air intake port is disconnected from the atmosphere, the switching mechanism including:

a case member having:

a first opening which is open to the atmosphere;

a suction port connection portion which is connected to the suction port of the cap member; and an air intake port connection portion which is connected to the air intake port of the cap member; and a switching member contained in the case member to switch a position of the switching member with respect to the case member; and a suction mechanism connected to the switching mechanism;

wherein, in a state that the cap member is attached to the liquid droplet jetting head, the switching member is configured to be switchable between a first position and a second position;

wherein the first position is a position:

at which a first communication passage for connecting the suction port connection portion and the suction mechanism is formed between the switching member and the case member; and at which the first opening and the air intake port connection portion are disconnected; and wherein the second position is a position:

at which the first communication passage is formed between the switching member and the case member; and at which a second communication passage for connecting the first opening and the air intake port connection portion is formed between the switching member and the case member.

2. The liquid droplet jetting apparatus according to claim 1;

wherein the case member further includes a second opening which is open to the atmosphere and different from the first opening;

wherein, in a state that the cap member is attached to die liquid droplet jetting head, the switching member is configured to be further switchable to a third position, at which a third communication passage for connecting the suction port connection portion and the second opening is formed between the switching member and the case member, and at which the first opening and the air intake port connection portion are disconnected; and wherein a flow passage resistance of die second communication passage is smaller than a flow passage resistance of the third communication passage.

3. The liquid droplet jetting apparatus according to claim 2;

wherein the case member has a cylindrical shape;

wherein the switching member has a columnar shape and is configured to switch the position of the switching member by rotating about a central axis of the case member while making an outer circumferential surface of the switching member slide on an inner surface of the case member;

wherein the outer circumferential surface of the switching member includes:

a first groove which forms the second communication passage between the switching member and the case member in the state that the switching member is positioned at the second position; and a second groove which forms the third communication passage between the switching member and the case member in the state that the switching member is positioned at the third position are formed; and wherein a depth of the first groove is greater than a depth of the second groove.

4. The liquid droplet jetting apparatus according to claim 1;

wherein the case member has a cylindrical shape;

wherein the switching member is has a columnar shape and is configured to switch the position of the switching member by rotating about a central axis of the case member while making an outer circumferential surface of the switching member slide on an inner surface of the case member; and wherein the first opening and the air intake port connection portion are aligned in a direction along the central axis of the case member.

5. The liquid droplet jetting apparatus according to claim 4;

wherein the central axis of the case member extends in a vertical direction; and wherein the first opening is formed at a position higher than a position at which the air intake port connection portion is formed.

6. The liquid droplet jetting apparatus according to claim 1, further comprising a drive mechanism configured to switch the position of the switching member;

wherein, under a condition that a purge operation, in which the liquid is discharged from the nozzle to the cap member by driving the suction mechanism in a state that the cap member is attached to the liquid droplet jetting head, is performed, the drive mechanism is configured to position the switching member at the first position; and wherein, under a condition that an idle suction operation, in which the liquid discharged to the cap member is sucked from the cap member by driving the suction mechanism in the state that the cap member is attached to the liquid droplet jetting head, is performed, the drive mechanism is configured to switch the position of the switching member from the first position to the second position.

* * * * *